US006632014B2

(12) United States Patent
Steinberg et al.

(10) Patent No.: US 6,632,014 B2
(45) Date of Patent: Oct. 14, 2003

(54) DEVICE AND METHOD FOR MIXING SUBSTANCES

(75) Inventors: Victor Steinberg, Rehovot (IL); Alexander Groisman, Rehovot (IL)

(73) Assignee: Yeda Research and Development Co., Ltd., Rehovot (IL)

( * ) Notice: Subject to any disclaimer, the term of this patent is extended or adjusted under 35 U.S.C. 154(b) by 69 days.

(21) Appl. No.: 09/729,526

(22) Filed: Dec. 4, 2000

(65) Prior Publication Data

US 2002/0093878 A1 Jul. 18, 2002

(51) Int. Cl.[7] ..... B01F 5/06; B01F 7/26
(52) U.S. Cl. ..... 366/315; 366/338; 366/348
(58) Field of Search ..... 366/338, 341, 366/315, 316, 339, 336, 348, 349

(56) References Cited

U.S. PATENT DOCUMENTS 2,933,293 A * 4/1960 Ferrari, Jr.
3,459,407 A * 8/1969 Hazlehurst et al. ..... 366/338
3,479,141 A * 11/1969 Smythe et al.
3,927,868 A * 12/1975 Moore ..... 366/341
4,410,281 A * 10/1983 Crookes ..... 366/341
4,422,773 A * 12/1983 Cassaday et al. ..... 366/341
4,572,435 A * 2/1986 Thompson ..... 366/341
4,643,336 A * 2/1987 Mandeville et al. ..... 366/339
4,833,175 A * 5/1989 Boyce
5,350,233 A * 9/1994 Sonntag et al. ..... 366/339
5,433,084 A * 7/1995 Kaiser et al. ..... 366/339
5,556,033 A * 9/1996 Nachtman ..... 239/343
5,595,712 A * 1/1997 Harbster et al. ..... 366/339
5,826,981 A * 10/1998 Fowler et al. ..... 366/336
5,842,787 A * 12/1998 Kopf-Sill et al. ..... 366/341
5,880,184 A * 3/1999 Lazarus ..... 460/27
5,909,959 A * 6/1999 Gerich ..... 366/339
6,331,072 B1 * 12/2001 Schierholz et al. ..... 366/338

OTHER PUBLICATIONS

Shraiman, B.I. & Siggia, E.D. Scalar turbulence, Nature, 405, 639–645 (Jun. 2000).
Warhaft, Z, Passive scalars in turbulent flows Annu.Rev. Fluid Mech. 32,203–240 (2002).
Bird, R.B., Curtiss, C.F., Armstrong, R.C. & Hassager, O., Dynamics of polymeric liquids, John Wiley, NY, 1987.
R.G. Larson et al., "A Purely Viscoelastic Instability in Taylor–Coutte Flow", J Fluid Mech., 218, 573–600, (Jul. 6, 1989).
Byars, J.A., Oztekin, A., Brown R.A. & McKinley, G.H., Spiral instabilities in the flow of highly elastic fluids between rotating parallel disks, J. Fluid Mech., 271, 173–218 (Jan. 24, 1994).
Joo, J.L. & Shaqfeh, E.S.G., Observations of purely elastic instabilities in the Taylor–Dean flow of a Boger fluid, J. Fluid Mech. 262, 27–73 (Aug. 23, 1993).
A. Groisman and V.Steinberg, "*Elastic Turbulence in Polymer Solution Flow*", Nature 405, pp. 53–55, 2000.

* cited by examiner

*Primary Examiner*—Tony G. Soohoo
(74) *Attorney, Agent, or Firm*—Browdy and Neimark PLLC

(57) ABSTRACT

A method and device for mixing a liquid with another substance are presented. The mixing is based on creation of a turbulent flow of the liquid, by providing curvilinear trajectories of the flow and providing a polymer material in the liquid flow.

17 Claims, 7 Drawing Sheets

DEVICE AND METHOD FOR MIXING SUBSTANCES

FIELD OF THE INVENTION

This invention relates to a device and method for mixing substances, particularly very viscous substances in small volumes.

BACKGROUND OF THE INVENTION

The mixing of liquids is essential for many industrial and laboratory processes, and has been addressed in the past, for example in the following publications:

(1) Shraiman, B. I. & Siggia, E. D. Scalar turbulence, *Nature,* 405, 639–545 (2000).

(2) Warhaft, Z., Passive scalars in turbulent flows *Annu. Rev. Fluid Mech.* 32, 203–240 (2000).

Since the process of molecular diffusion is typically characterized by a long characteristic time, rapid mixing almost always requires some macroscopic flow, which is regularly induced by stirring or shaking. In order to provide efficient mixing, however, the flow needs to be chaotic or turbulent. It is known that a flow is likely to be turbulent, when the Reynolds number, Re, is large ($Re=VL/\nu$, wherein V is the liquid velocity, L is the size of a tank in which the liquid flows, and $\nu$ is the kinematic viscosity of the liquid). Thus, in order to obtain a high Reynolds number, the liquid velocity and the tank size should be sufficiently large while the liquid should be of low viscosity. When the liquids are very viscous and/or the tank is small, the velocity required to create a turbulent flow may be so high, that it becomes quite impractical. In this case, liquids arc usually mixed in closed mixers. However, this interrupts the continuous technological processes and requires a lot of energy to provide a homogeneous mixture.

It is known that solutions of flexible high molecular weight polymers differ from newtonian fluids in many aspects. The most notable elastic property of the polymer solution is that stress does not immediately become zero, when the fluid motion stops, but rather decays with some characteristic time, $\lambda$, which can reach seconds and even minutes. The equation of motion for dilute polymer solutions differs from the Navier-Strokes equation defining the motion of simple, low molecular weight newtonian fluids by an additional linear term arising from the elastic stress. Since the elastic stress is caused by stretching of the polymer coils, it depends on history of motion and deformations of fluid elements along their flow trajectories. This implies a non-linear relationship between the elastic stress and the rate of strain in the flow. These features can be learned from the following publication:

(3) Bird, R. B., Curtiss, C. F., Armstrong, R. C. & Hassager, O., *Dynamics of polymeric liquids,* John Wiley, NY, 1987.

The non-linear mechanical properties of viscoelastic fluids can lead to many special flow effects, such as purely elastic transitions that quantitatively change character of the flow at vanishingly small Reynolds number. This is disclosed in the following publications:

(4) R. G. Larson et al., "A Purely Viscoelastic Instability in Taylor-Couette Flow", J. Fluid Mech., 218, 573–600, 1990;

(5) Byars, J. A., Öztekin, A., Brown R. A. & McKinley, G. H., Spiral instabilities in the flow of highly elastic fluids between rotating parallel disks, *J. Fluid Mech.,* 271, 173–218 (1994).

(6) Joo, J. L. & Shaqfeh., E. S. G., Observations of purely elastic instabilities in the Taylor-Dean flow of a Boger fluid, *J. Fluid Mech* 262, 27–73 (1994).

As a result of such transitions, secondary vortical flow appears in different systems, where the primary motion is a curvilinear shear flow. The onset of those secondary flows depends on the Weissenberg number, Wi, determined as $Wi=\lambda\gamma$, wherein $\lambda$ is the polymer relaxation time, and $\gamma$ is the shear rate. The Weissenberg number plays a role analogous to that of the Reynolds number in competition between non-linearity and dissipation.

SUMMARY OF THE INVENTION

There is a need in the art to facilitate the mixing of substances, by providing a novel method and device that enables the efficient mixing of substances even very viscous, in small volumes, at arbitrary low Reynolds numbers. The present invention provides for the gentle mixing of viscous liquids in small size channels at low velocities and small applied stresses, as well as mixing between a viscous liquid and a powder.

It has been found by the inventors that the flow of a sufficiently elastic polymer solution can become very irregular even at low velocity, high viscosity, and in a small volume (tank). The fluid motion is excited in a broad range of spatial and temporal scales, and the flow resistance significantly increases (by a factor up to twenty), thereby presenting a turbulent flow. These main features of turbulence appear in a flow of a highly elastic polymer solution, even at arbitrarily low Reynolds numbers. A comparable state of turbulent flow for a newtonian fluid in a pipe would have a Reynolds number as high as $10^5$.

The inventors have found that the nonlinearity of mechanical properties of a fluid can give rise to a turbulent flow when the equation of motion is linear. For a polymer solution, this corresponds to a state in which the Weissenberg number is high, while the Reynolds number is small. This situation can be realized if the parameter of elasticity, $Wi/Re=\lambda\nu/L^2$, is large enough, wherein L is characteristic size and $\nu$ is kinematic viscosity of the fluid.

The main idea of the present invention is based on the creation of turbulence in a liquid (even very viscous liquid) in a flow with curvilinear trajectories, by adding a small amount of polymer. This can be used for mixing this liquid with another substance (liquid or powder). The flow of an elastic polymer solution at sufficiently high values of Weissenberg number, Wi, has all the main features of the developed turbulence. The increase in the flow resistance resulting in the turbulence of the flow is due to the elastic stress provided by the presence of a polymer material.

There is thus provided according to one aspect of the present invention a method of creating a turbulent flow of a liquid, the method comprising the step of providing a polymer material in the liquid flow with curvilinear trajectories.

For the purposes of the present invention, the presence of a polymer material of at least 0.001% concentration is sufficient. Preferably, the polymer material is a flexible high molecular weight polymer.

The above technique can be used for effective mixing of the liquid with another substance (liquid or powder). The efficient mixing can be carried out at arbitrary small Reynolds numbers.

According to another aspect of the present invention, there is provided a method of mixing substances, at least one of the substances being a liquid, the method comprising the steps of:

(i) providing a continuous flow of the substances with curvilinear trajectories of the flow: and (ii) providing a polymer material in the liquid flow, thereby creating turbulence of the flow.

To provide effective mixing of the substances, the flow periodically turns, resulting in that the difference in the concentration of the substances in the flow exponentially reduces. A characteristic length of the path defining effective mixing of the substances is preferably such that this difference reduces by about 3 times.

According to some embodiments of the invention, the curvilinear trajectories of the flow are achieved by directing the flow along a serpentine- or worm-like channel, so as to provide an open continuous flow of the substances through the channel between inlet and outlet openings thereof. According to another embodiment of the invention, the curvilinear trajectories of the flow are achieved by circulating the substances in a cylindrically shaped mixing tank. Such a tank defines a closed continuous flow of the substances with the curvilinear trajectories of the flow.

According to yet another aspect of the present invention, there is provided a mixing device for mixing substances, at least one of the substances being a liquid, the mixing device comprising:

(a) a mixing tank for a flow of the substances therein with curvilinear trajectories of the flow; and (b) a supply means for supplying the substances into the tank with presence of a polymer material in the liquid flow.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF THE INVENTION

Figure 1A:
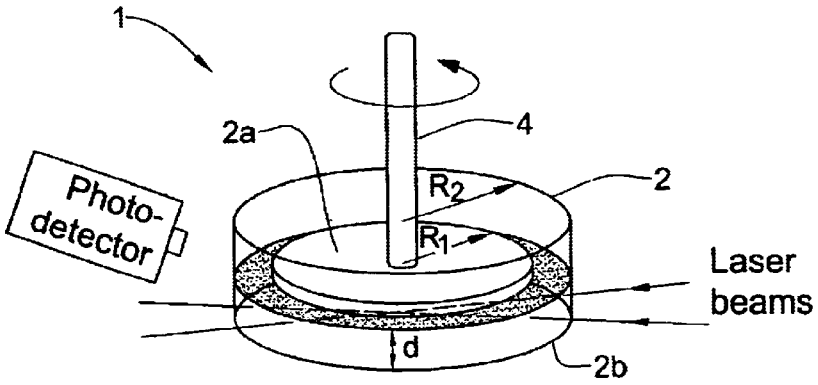
FIGS. 1*a* to 1*c* schematically illustrate three examples of a mixing tank suitable to be used in a mixing device according to the invention.

Referring to FIG. 1*a*, there is illustrated an example of a device 1 suitable to be used as a mixing device according to the invention. The device 1 comprises a cylindrical cup 2 (constituting a mixing tank) having upper and lower concentric plates 2*a* and 2*b* (i.e., parallel disks) for a liquid to be supplied into a spaced therebetween until a level d. The upper plate 2*a* is mounted for rotation being attached to a rotating shaft 4, and just touches the surface of the liquid to provide a swirling flow of the liquid between the disks. A special cover is used to minimize evaporation of the liquid. The space between the disks 2*a* and 2*b* thus presents a cavity for a closed continuous flow of a liquid thereinside with curvilinear trajectories of the flow.

Following is an example illustrating the creation of a turbulent flow of a liquid in the tank 2. In the present example, the radii of the upper and the lower plates are $R_1$=38 mm and $R_2$=43.6 mm, respectively. The liquid used is a solution of 65% saccharose and 1% NaCl in water, viscosity $\eta_s$=0.324 Pa·s, as a solvent for added polymer, which is polyacrylamide ($M_W$=18,000,000; Polysciences) at a concentration of 80 p.p.m by weight. The viscosity of the so-obtained solution is $\eta$=0.424 Pa·s at $\gamma$=1 $s^{-1}$. The curvature ratio is quite high, d/R=0.263, to provide destabilization of the primary shear flow and development of the secondary vortical fluid motion at lower shear rates.

For experimental purposes, the whole flow set-up 1 is mounted on top of a commercial viscometer (AR-1000 of TA-instruments) to measure precisely the angular velocity $\omega$, of the rotating upper plate and the torque applied to it, to estimate the average shear stress in a polymer solution flowing inside the cup. The walls of the cup 2 are transparent, which allows Doppler velocimeter measurements by collecting light scattered from the crossing point of two horizontal laser beams. The flow is observed from below. The lower plate 2*b* of the cup is made from plexiglass, and a mirror (not shown) tilted by 45° is placed under the lower plate. The flow patterns are then captured by a CCD camera (photodetector) at the side, and the temperature is stabilized at 12° C. by circulating air in a closed box. The flow under the black upper plate is visualized by seeding the liquid with light reflecting flakes (1% of the Kalliroscope liquid). The liquid is illuminated by ambient light. The relaxation time, $\lambda$, estimated from the phase shift between the stress and the shear rate in oscillatory tests, was 3.4 s.

Figure 2:
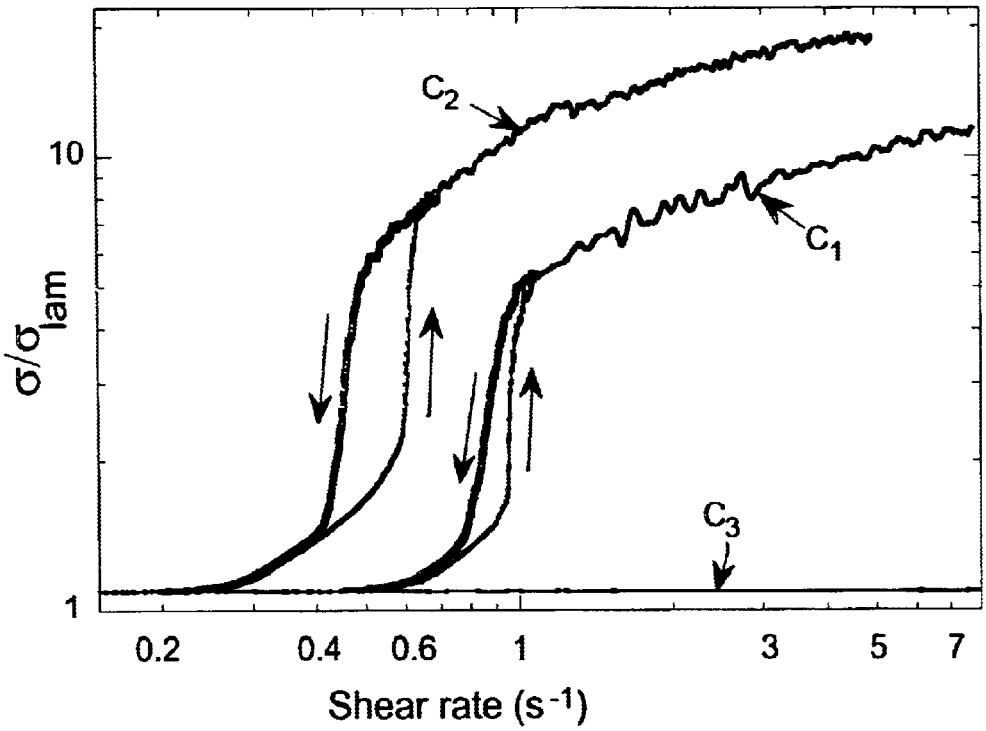
FIG. 2 graphically illustrates a stress ratio as a function of a shear rate as obtained with the mixing tank of FIG. 1*a;*

FIG. 2 graphically illustrates the measurement results, showing stress ratio as functions of shear rate. The ratio of the average stress $\sigma$, measured in the flow to the stress $\sigma_{lam}$ in a laminar flow with the same boundary conditions is plotted as a function of the shear rate, $\gamma$. Two curves $C_1$ and $C_2$ correspond to the polymer solution flow with $d_j$=10 mm and $d_2$=20 mm, respectively. The shear rate was gradually varied in time, very slowly (by about 10% $h^{-1}$) in the transition region, and faster below and above it. In the graphs, thin black lines represent increasing $\gamma$; and thick gray lines represent decreasing $\gamma$. Curve $C_3$ represents the pure solvent. As shown, mechanical degradation of the polymers is quite small at shear rates below 1.5 $s^{-1}$ and 1 $s^{-1}$ for d=10 mm and 20 mm, respectively. The dependence of $\sigma/\sigma_{lam}$ on $\gamma$ in those regions were therefore reproducible in consecutive runs within about 1%. Degradation effects became appreciable at higher shear rates, and elasticity typically decreased by up to 10% as a result of the runs shown by curves $C_1$ and $C_2$.

Figure 3:
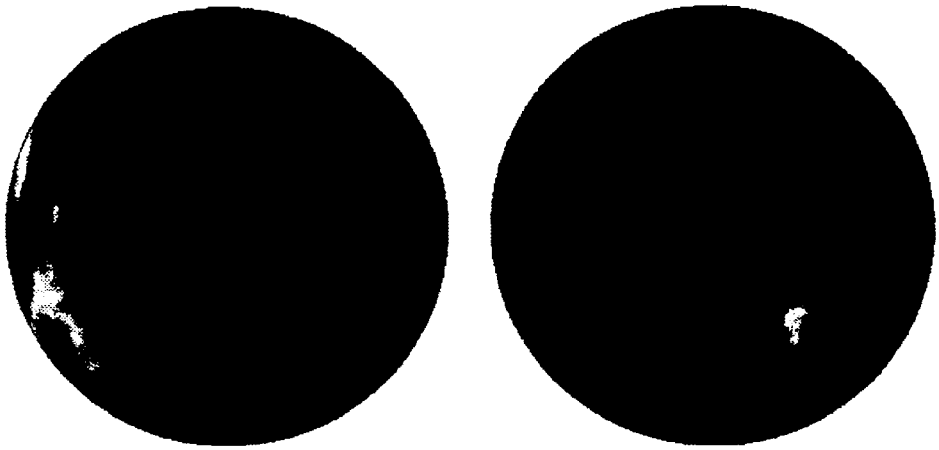
FIG. 3 illustrates two snapshots of the flow obtained in the tanks of FIG. 1*a*, showing turbulence of the flow at Wi=13 and Re=0.7.

FIG. 3 shows two snapshots of the flow at Wi=13, Re=0.7. As shown, although the pattern is quite irregular, structures that appear tend to have spiral-like forms. The dark spot in the middle corresponds to the center of a big persistent thoroidal vortex that has dimensions of the whole set-up.

Thus, the experimental results have shown that by adding a high molecular weight polymer into a liquid, and providing curvilinear trajectories of a flow of the liquid with polymer, the turbulence of flow can be obtained. More particulars of the above experiment can be learned from the following article: A. Groisman and V. Steinberg, "Elastic Turbulence in a Polymer Solution Flow", Nature, 405, 53–55, 2000. The disclosure in this article is therefore incorporated herein by reference.

The cup 2 can thus be used as a mixing tank for mixing two substances, wherein one of the substances is a liquid containing a polymer (e.g., the above indicated solution). The mixing tank 2 is of a kind providing a closed continuous motion of the substances, such that the polymer-containing liquid moves along a circular trajectory inside the tank. It has been found that effective mixing is achieved on a length of the liquid path of about 100 times of the distance between the disks 2*a* and 2*b*. The degree of mixing is almost independent of the size of the tank, viscosity of the liquid and the flow velocity, which can be very low.

Figure 1B:
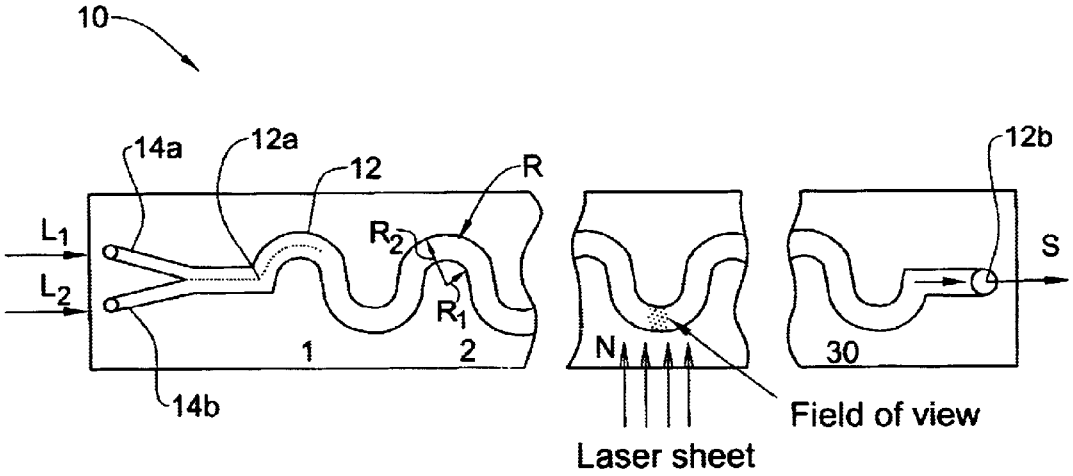
Figure 1C:
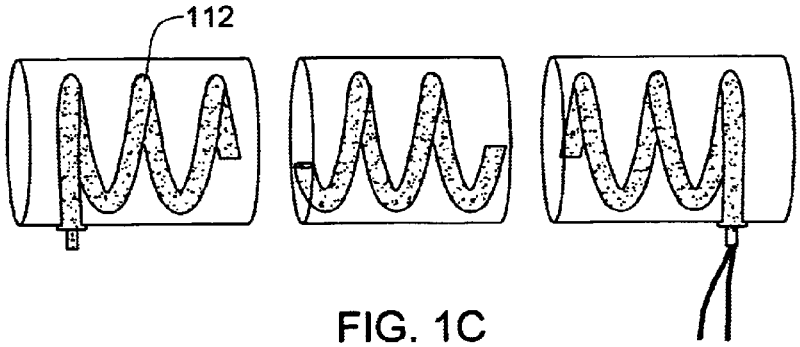

Referring now to FIGS. 1*b* and 1*c*, there are illustrated two more examples of a mixing tank suitable to be used in the present invention for mixing substances. In each of these examples, a mixing device utilizes a mixing tank of a kind providing an open continuous flow of substances therein-side. In a device 10 (FIG. 1*b*) a mixing tank 12 is configures to define a curvilinear channel of a serpentine shape, while a mixing tank 112 (FIG. 1*c*) defines a worm-like channel.

More specifically, the tank 12 of FIG. 1*b* is composed of a sequence of N smoothly connected half-rings (units), generally at R, having outer and inner diameters $R_1$ and $R_2$ of the ring. The path providing effecting mixing is defined by the characteristic length of the channel, which is about 50–100 times of the channel's width d. For experimental purposes, the channel is formed with an inlet opening 12A for feeding therein working substances $L_1$ and $L_2$ to be mixed (both being liquids in the present example), and an outlet opening 12B for discharging a resulting mixture S therefrom. The liquids $L_1$ and $L_2$ are fed into the channel by two syringe pumps (which are not specifically shown) at equal rates through two separate tubes 14A and 14B, respectively. The pumps and tubes constitute together a supply arrangement. To provide a turbulent flow of at least one of the liquids, a small amount of a polymer material (0.001% is sufficient) is added to this liquid.

Following is an example of a mixing technique carried out in the channel 12. In the present example, the following conditions are used. The liquids are identical, each containing a solution of 65% saccharose and 1% NaCl in water, with the viscosity $\eta_s$=0.153 Pa·s and density $\rho$=1.32 g/cm$^3$, as a solvent for the polymer. The polymer, which in the present example is added to both liquids, is polyacrylamide ($M_W$=18,000,000; Polysciences). One of the solutions is also added with $c_0$=2 p.p.m. of a fluorescent dye (fluorescene), used for measurement purposes, as will be clear from the description below. The solution viscosity is $\eta$=0.198 Pa·s at a shear rate $\gamma$=4 s$^{-1}$.

The channel of a depth d=3 mm is machined in a transparent bar of perspex and scaled from above by a transparent window. The outer and inner diameters $r_1$ and $r_2$ of the half-rings are, respectively, of 3 mm and 6 mm. The channel is square in the cross-section and has 30 repeating units, each with a linear dimension of 18 mm.

The experiment is carried out at a room temperature, i.e., 22.5±0.5° C. The total rate of the liquid supply, Q, into the channel was always kept constant, so that the average time of mixing inside the channel was proportional to the position N along the channel.

For the measurement purposes, the channel is illuminated from a side by an Argon-Ion laser beam converted by two cylindrical lenses to a broad sheet of light with a thickness of about 40 $\mu$m in the region of observation. The fluorescent light emitted by the liquid in the perpendicular direction is projected onto a CCD camera and digitized by a 8-bit 512×512 frame grabber. Concentration of the dye is evaluated from the intensity of the light, which was found to be proportional to the concentration.

The flow is always observed near the middle of the half-ring close to the side from which the laser beam comes. Hence, the number N of the unit is a natural linear coordinate along the channel.

The relaxation time, $\lambda$, estimated from the phase shift between the stress and the shear rate in oscillatory tests is 1.4 s. An estimate for the diffusion coefficient of the dye is given by that for the saccharose molecules, which is about D=8.5·10$^{-7}$ cm$^2$/s. The characteristic shear rate, $\gamma$, and the Weissenberg number $W_i$ in the flow are estimated as follows:

$$\gamma = \frac{2Q/d^2}{d/2} = \frac{4Q}{d^3}$$

$$Wi = \lambda\frac{4Q}{d^3}$$

The Reynolds number, Re=2Q$\rho$/(d$\eta$) was always quite low, reaching 0.6 for the highest value of Q in the experiment.

Figure 4A:
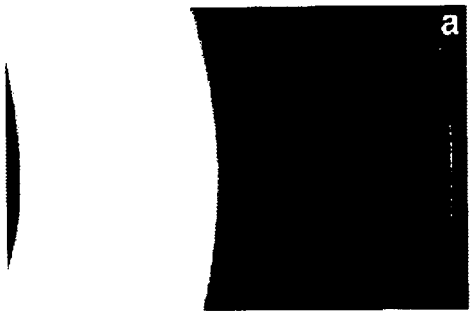
FIGS. 4*a* and 4*b* illustrate snapshots presenting the experimental results obtained with the mixing tank of FIG. 1*b;*
Figure 4B:
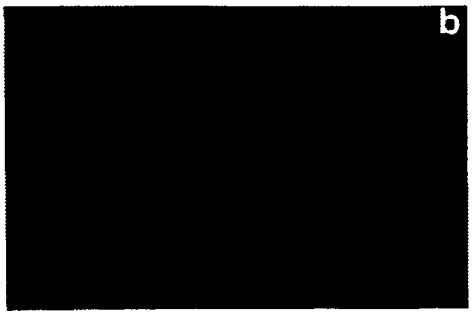

Referring to FIGS. 4*a* and 4*b*, there are shown snapshots of the flow at N=29 as imaged by the CCD camera during the liquids flow along the region of observation. FIG. 4*a* shows the situation for a pure solvent at Re=0.16, and FIG. 4*b* shows the situation for the polymer solution at the same flow rate, corresponding to Wi=6.7. In the figures, bright regions correspond to high concentrations of the fluorescent dye.

As shown in FIG. 4*a*, the small Reynolds number results in that the flow of the pure solvent remained quite laminar and no mixing occurred. The boundary that separates the liquid with and without the dye is smooth and parallel to the direction of the flow, and it became smeared due to molecular diffusion as the liquid advances downstream. Behavior of the polymer solution was qualitatively different from that of the solvent. The flow was laminar and stationary only up to a value of Q corresponding to $Wi_c$=3.2 (and Re=0.06), at which an elastic instability occurred. As shown in FIG. 4*b*, this instability leads to irregular flow and mixing of the liquids. The experiments were carried out at Q about twice above the flow instability onset, Wi=6.7, at which homogeneity of the mixture at the exit of the channel was the highest.

Figure 5:
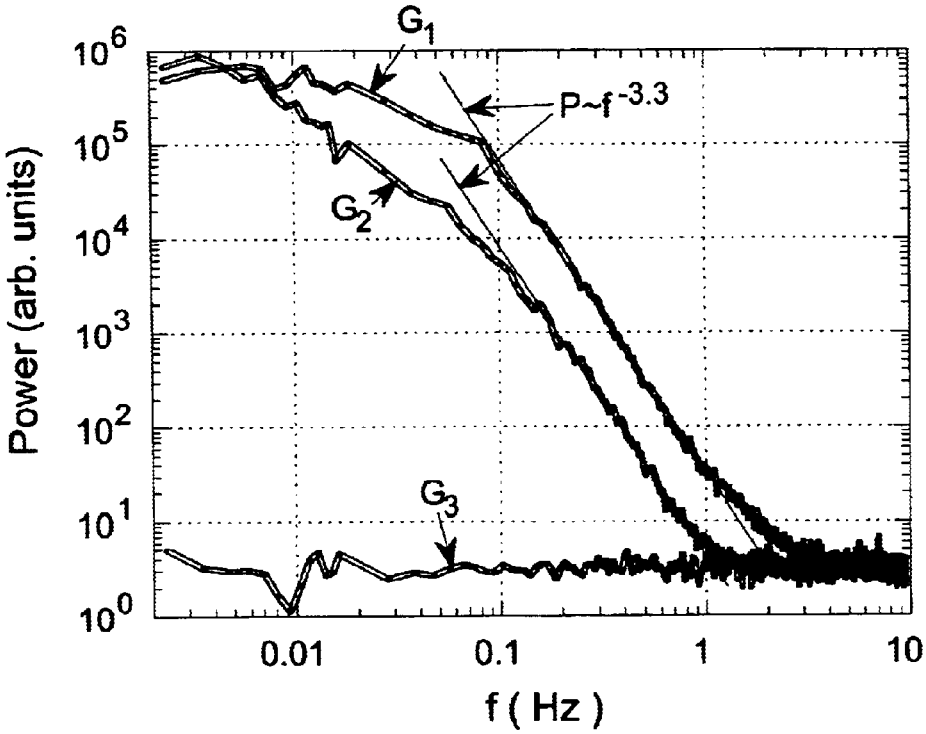
FIG. 5 illustrates the distribution of the power of velocity fluctuations in the middle of the channel of FIG. 1*b;*

Turning now to FIG. 5, there are illustrated three graphs $G_1$, $G_2$ and $G_3$ showing power spectra of fluctuations of the flow velocity in the middle of the channel at N=12 and Wi=6.7, i.e., P(f). Graph $G_1$ corresponds to the spectra of the velocity components for the polymer solution along the mean flow, graph $G_2$ corresponds to the same across the mean flow, and graph $G_3$—for the pure solvent across the mean flow. The flow velocity was measured by a laser Doppler anemometer, when the region of the laser beam crossing was made very small, i.e., 15×15×40 $\mu$m, in order to decrease the gradient noise. The mean velocity for the polymer solution was V=6.6 mm/s. The RMS of the fluctuations, $V_{rms}$, was 0.09V and 0.04V for, respectively, longitudinal and transversal directions. The spectra of both longitudinal and transversal velocity components do not exhibit any distinct peaks and have broad regions of a power decay, which is typical for turbulent flow.

Mixing of the polymer solution is a random process, and may therefore be characterized statistically by a probability distribution function (PDF) in order to find different concentrations, c, of the dye in a point, and by values of the moments, $M_i$, of the distribution. The $i^{th}$ moment is defined as an average $<|c-c_1|^i>/c_1^{\ i}$, wherein $c_1$ is the average concentration of the dye, which in the present example is equal to $c_0/2$, wherein $c_0$ is the initial concentration of the dye. Small values of the moments $M_i$ signify high homogeneity and good mixing of the liquids.

Figure 6A:
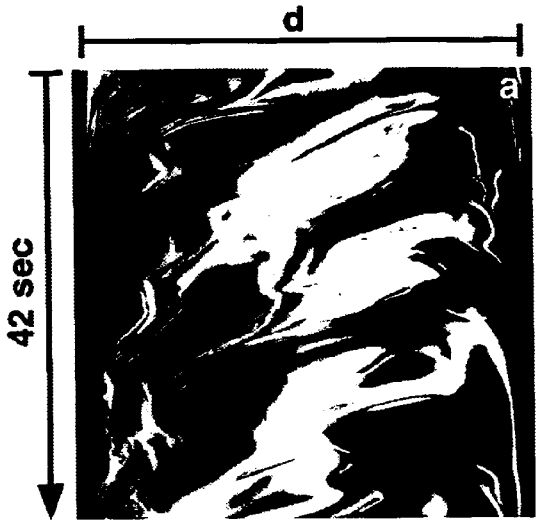
FIGS. 6*a* to 6*d* illustrate space-time plots of mixing a polymer solution at different positions along the channel.
Figure 6B:
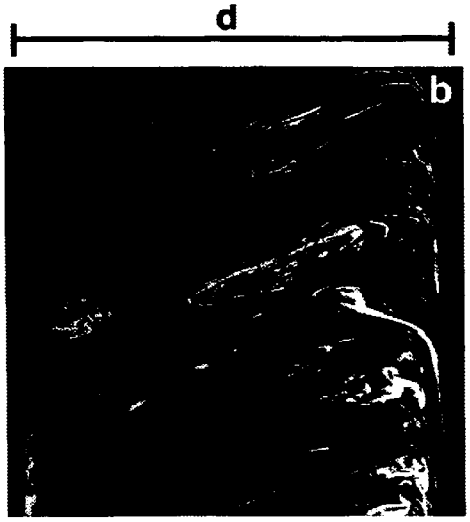

Reference is made to FIGS. 6*a*–6*b*, 7 and 8. FIGS. 6*a* and 6*b* illustrate space-time diagrams of the flow taken at different positions along the channel corresponding to different values of $M_1$, i.e. $M_1$=0.72, $N_1$=8 and $M_1$=0.25, $N_2$=24, respectively. The brightness profile was captured 12.5 times per second along a single line across the channel near the middle of a half-ring. Profiles measured at consecutive moments of time are plotted as horizontal lines from top to bottom.

Figure 7:
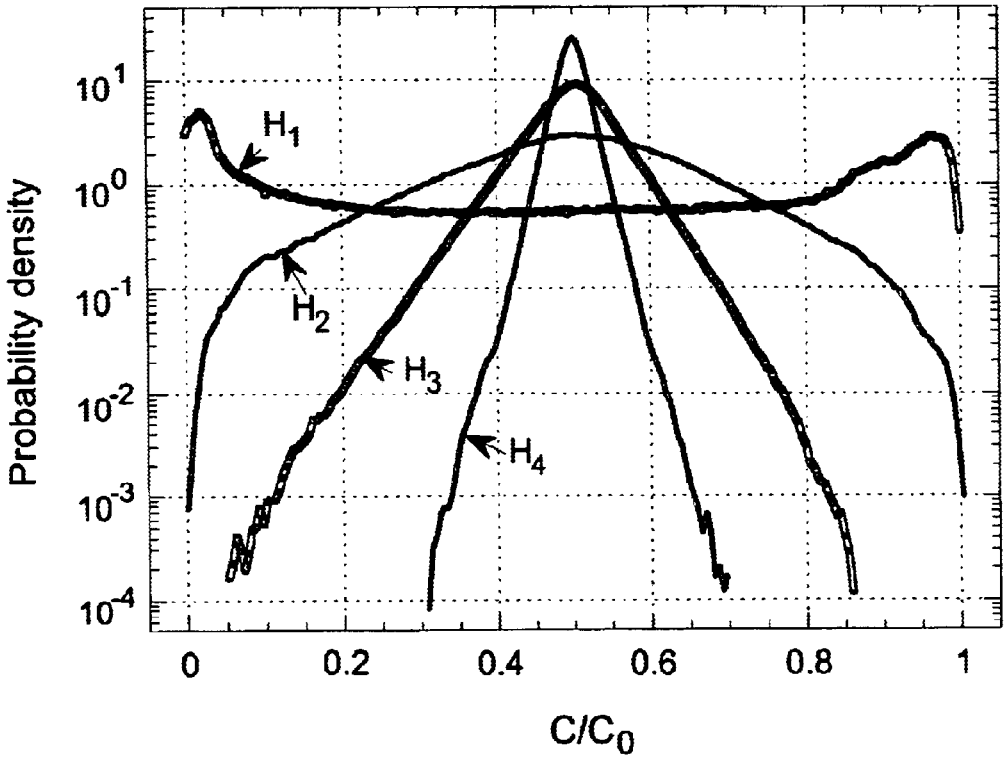
FIG. 7 illustrates plots of PDF of concentration of a fluorescent dye at different positions in the channel.

FIG. 7 illustrates PDF of the concentration of the fluorescent dye at different positions, wherein each graph represents statistics over about $10^7$ points corresponding to about 50 space-time diagrams, and a total liquid discharge of $2\cdot10^3d^3$. The regions near the walls of the channel with the width of 0.1 d were excluded from the statistics. Graphs $H_1$ and $H_2$ in the figure correspond to the situations of FIGS. 6*a* and 6*b*.

Figure 8:
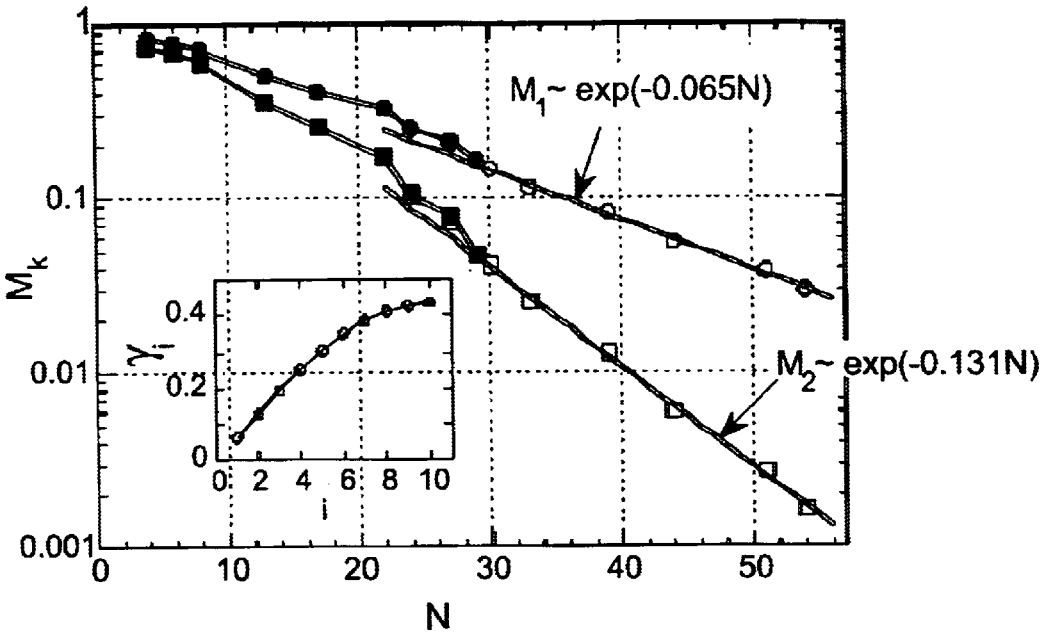
FIG. 8 illustrates the dependence of the moments of distribution on the position along the channel.

FIG. 8 illustrates dependences of the $M_1$ and $M_2$ values (represented by dark symbols) on the position N along the channel. The average flow time $t_0$ is connected to N as follows: $t_0$=N·7.8s.

Figure 6C:
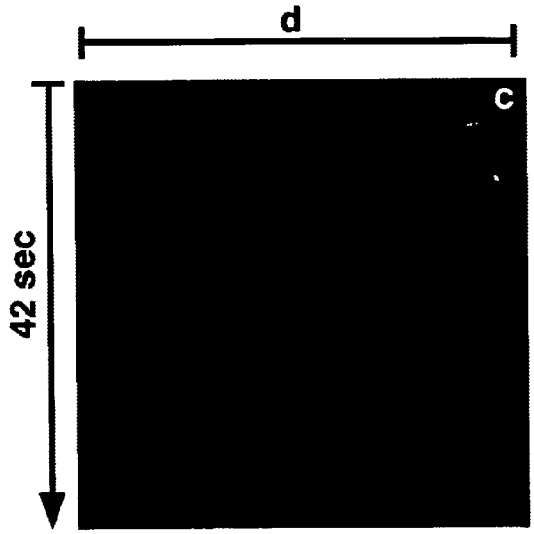
Figure 6D:
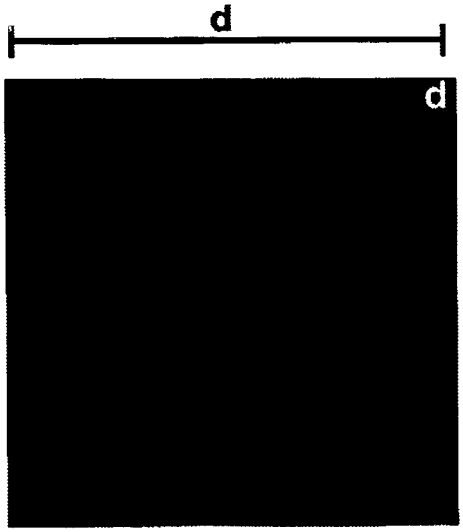

In order to observe further stages of mixing, a series of experiments were carried out, where the liquids were premixed before they entered the channel. For these purposes, a shorter channel with the same shape was used and accommodated upstream of the channel 12, such that the liquids were first passed through the shorter channel and then entered the channel 12. The experimental results are shown in FIGS. 6*c*–6*d*, FIG. 7 (graphs $H_3$ and $H_4$) and FIG. 8 (light symbols). The space-time plots (FIGS. 6*c* and 6*d*) were taken at positions corresponding to $M_1$=0.082 ($N_3$=39), and $M_1$=0.030 ($N_4$=54), respectively.

As a result of premixing, PDF of the dye concentrations at N=2 was almost identical to PDF at N=27 without the premixing. Hence, in FIG. 8, the values $M_1$ and $M_2$ for the flow with the premixing are plotted on the same graph adding a number of 25 to the position N along the channel. It is seen that the curves plotted for the liquids premixing case are indeed continuations of the dependences obtained for the values $M_1$ and $M_2$ in the channel without the premixing.

Thus, as the liquid flows downstream, it becomes increasingly homogeneous and PDF of the dye concentration becomes narrower. As shown, in FIGS. 6*a* and 7 (graph $H_1$), there are large homogeneous regions with maximal and zero dye concentration, and PDF has a maximal value near $c_0$ and zero. The dependences on the entrance condition fades gradually as the liquids flow downstream and get mixed. Therefore, the space-time diagram in FIG. 6*b* has a lot of fine scale structures of different brightnesses. The corresponding PDF (FIG. 7, graph $H_2$) has a single peak at $c_1$, and long tails that decay exponentially and touch the limits of the concentration, zero and $c_0$. Further downstream, the space time diagram (FIG. 6*c* corresponding to N=39) exhibits characteristic features at similar spatial scale, but are much more faded. The PDF (FIG. 7, graph $H_3$) is much narrower and has quite clear exponential tails, which imply strong intermittency in mixing. The distribution is well confined in a region far from the limits of zero and $c_0$. Hence, the dependence on the initial condition should be quite minor by that point. At the last point (FIG. 6*d*), the non-homogeneity in the concentration is hardly seen, and the PDF (FIG. 7, graph $H_4$) is very narrow.

Figure 9:
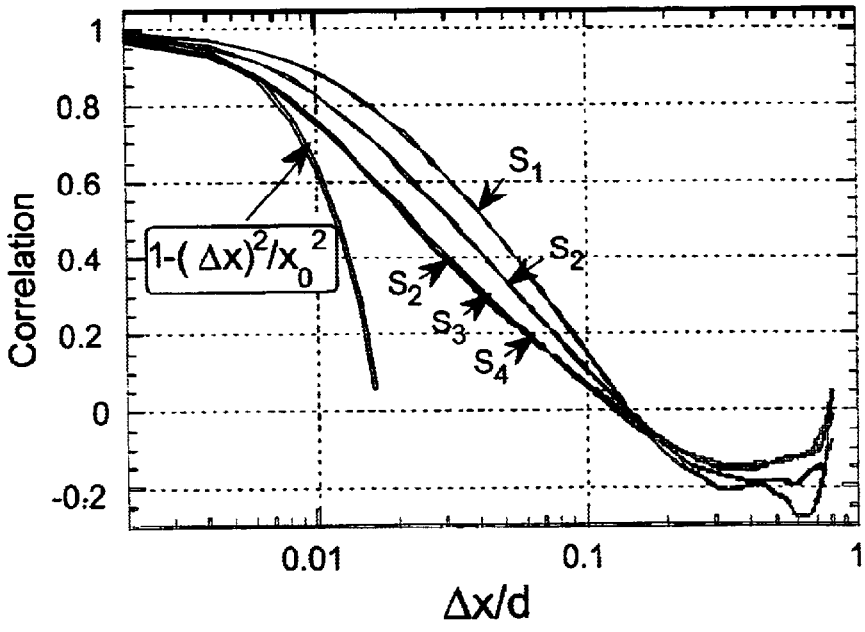
FIG. 9 illustrates correlation coefficients for the concentration as functions of the distance across the channel.

FIG. 9 illustrates representative spatial autocorrelation functions for the dye concentration, namely, the correlation coefficients for the concentration as functions of the distance $\Delta_x$ across the channel. Here, graphs $S_{1-S4}$ correspond to the graphs $H_1$–$H_4$ of FIG. 7 and to the space-time plots in FIGS. 6*a*–6*d*, respectively. At large N (N>29), the correlation functions at different positions become identical.

It is evident from FIG. 8, that both $M_1$ and $M_2$ decay exponentially above N=30, the rate of the decay being two times higher for $M_2$ than that for $M_1$. The higher order moments were found to decay exponentially, $M_i \sim \exp(-\gamma_i N)$, as well.

Turning back to FIG. 5, spatial structure of the flow in the channel can be inferred from the power spectra shown in the figure, if the Taylor hypothesis disclosed in the above publications (1) and (2) is applied. This spectra imply that the power of the velocity fluctuations scales with the k-number in space as $P \sim k^{-3.3}$. Fluctuations of the velocity gradients should thus scale as $k^{-1.3}$, so that the flow becomes increasingly homogeneous at small scales, and mixing is mainly due to the largest eddies having the size of the whole flow system.

In an another example of the present invention, a more concentrated sugar syrup (as compared to that used in the previously described example) was used as a solvent, and a polymer solution was prepared with viscosity and relaxation time about two times larger man those of the original solution. With this polymer solution, substantially the same efficiency of mixing was obtained at corresponding Wi, while characteristic flow rates were twice lower, and Re was about four times lower. Dependence of the efficiency of mixing at the optimal flow conditions on concentration of the polymers was very weals (although $Wi_c$ grew fast, when the polymer concentration was decreasing). Hence, for a solution with the polymer concentration of 10 p.p.m. ($\eta/\eta_s$= 1.03), $M_1$ of as low as 0.22 was reached at N=29 (and at Re=0.065). The mixing was observed down to the polymer concentration of 7 p.p.m.

The advantages of the present invention are thus self-evident. By providing turbulence of the flow of a liquid by adding it with a polymer material, it can be easily and efficiently mixed with another liquid or powder. Very viscous liquids can be efficiently mixed at very low flow rates with the aid of polymer additives at very low concentrations.

Those skilled in the art will readily appreciate that various modifications and changes can be applied to the preferred embodiment of the invention as hereinbefore exemplified without departing from its scope defined in and by the appended claims.

What is claimed is:

1. A method of creating an elastic turbulent flow of a liquid, the method comprising:

providing a flow of said liquid with curvilinear trajectories of the flow, and providing in said flow of liquid an elastic polymer material soluble in said liquid wherein the flow is defined by the elasticity of the polymer.

2. The method according to claim 1, wherein the concentration of the polymer material is at least 0.001%.

3. The method according to claim 1, wherein said polymer material is a flexible high molecular weight polymer of $10^6$ $g\cdot mol^{31\ 1}$ or higher.

4. The method according to claim 1, and further comprising the step of supplying a substance into said flow with the curvilinear trajectories, thereby enabling mixing of said liquid with the substance.

5. The method according to claim 4, wherein the mixing is carried at low Reynolds numbers up to 0.06 or less.

6. A method of mixing substances, at least one of the substances being a liquid, the method comprising):

(i) providing a continuous flow of the substances with curvilinear trajectories of the flow; and (ii) providing in the liquid flow an elastic polymer material soluble in the liquid, thereby creating elastic turbulence of the flow defined by the elasticity of the polymer and wherein the elastic turbulence of the liquid is substantially irrespective of a Reynolds number of the flow.

7. The method according to claim 6, wherein the concentration of the polymer material is at least 0.001%.

8. The method according to claim 6, wherein said polymer material is a flexible high molecular weight polymer of $10^6$ $g{\cdot}mol^{31\ 1}$ or higher.

9. The method according to claim 6, wherein the mixing is carried out at low Reynolds numbers up to 0.06 or less.

10. The method according to claim 6, wherein said flow is a continuous flow of a solution of the substances with the polymer along an open-end curvilinear channel.

11. The method according to claim 10, wherein said channel defines a serpentine-like path.

12. The method according to claim 10, wherein said channel defines a worm-like path.

13. The method according to claim 6, wherein said flow is a closed-loop continuous flow of the solution of the substances with the polymer with the curvilinear trajectories of the flow.

14. A mixing device for mixing substances, at least one of the substances being a liquid, the mixing device comprising:

a mixing tank of cylindrical shape having upper and lower disks, a space between the disks forming a mixing channel for a flow of the substances with a polymer material soluble in the liquid, at least one of the upper and lower disks being mounted for rotation to thereby provide a closed loop flow of the solution of the substances with the polymer in the channel with curvilinear trajectories of the flow.

15. A mixing device for mixing substances, at least one of the substances being a liquid, the mixing device comprising:

(a) a mixing channel for a flow of the substances therein, the channel being formed in a mixing tank of a cylindrical shape having upper and lower disks for the substances to be supplied into a space between the disks, at least one of the upper and lower disks being mounted for rotation, the rotation of the at least one of the disks providing a closed-loop continuous flow of the substances in the channel with curvilinear trajectories of the flow; and (b) a supply means for supplying the substances into the channel with presence of a polymer material soluble in the liquid.

16. A method of mixing substances, at least one of the substances being a liquid, the method comprising:

providing a solution of the substances with a polymer soluble in said liquid in a cylindrically-shaped space between two disks; and rotating at least one of the disks, thereby providing a continuous flow of said solution of the substances with the polymer in said space with curvilinear trajectories of the flow, said flow being turbulent thereby assisting in the mixing of the substances.

17. A method of creating a turbulent flow of a liquid, the method comprising: providing a flow of said liquid with curvilinear trajectories of the flow, and providing in said flow of liquid a polymer material, which is soluble in said liquid and is a flexible high molecular weight polymer of $10^6$ $g{\cdot}mol^{31\ 1}$ or higher.

* * * * *